US006578842B2

(12) United States Patent
Hoberock

(10) Patent No.: US 6,578,842 B2
(45) Date of Patent: Jun. 17, 2003

(54) METHODS AND APPARATUS FOR MOVING MEDIA ALONG A MEDIA PATH

(75) Inventor: Tim M. Hoberock, Boise, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 0 days.

(21) Appl. No.: 09/898,982

(22) Filed: Jul. 2, 2001

(65) Prior Publication Data

US 2003/0001334 A1 Jan. 2, 2003

(51) Int. Cl.[7] ..... B65H 3/06
(52) U.S. Cl. ..... 271/117; 271/265.01; 271/272
(58) Field of Search ..... 271/272, 274, 271/265.01, 117, 109, 110

(56) References Cited

U.S. PATENT DOCUMENTS 3,970,298 A * 7/1976 Irvine et al. ..... 271/122
4,535,614 A * 8/1985 Oka ..... 72/11.6
5,253,862 A * 10/1993 Acquaviva et al. .... 271/265.01
5,342,037 A * 8/1994 Martin ..... 271/111
5,462,267 A * 10/1995 Hori ..... 271/110
5,873,291 A * 2/1999 Sand ..... 83/260
6,378,858 B1 * 4/2002 Suga ..... 271/117

* cited by examiner

*Primary Examiner*—David H. Bollinger

(57) ABSTRACT

Methods and apparatus for moving media along a media path employ an increase in the force with which a gripping surface contacts the media in order to compensate for wear experienced by the gripping surface. The force is increased as a function of a measured variable which can be the number of revolutions of a feed roller on which the gripping surface is defined. The variable can alternatively be elapsed time, or can be a number of sheets of media that pass a given point on the media path. An apparatus in accordance with the present invention includes a wear compensator which is configured to cause the increase in force with which the gripping surface contacts the media.

13 Claims, 3 Drawing Sheets

METHODS AND APPARATUS FOR MOVING MEDIA ALONG A MEDIA PATH

FIELD OF THE INVENTION

This invention pertains to methods and apparatus for moving and handling sheet media, including plastic film and paper. More specifically, the invention pertains to methods and apparatus to compensate for performance loss in media-contacting surfaces in imaging devices, such as printers and copiers, due to wear of such surfaces.

BACKGROUND OF THE INVENTION

Many various types of prior art imaging devices are known. Imaging devices are employed to produce visual images on sheets of media. Media is typically in the form of paper, but can also be in other forms such as plastic transparencies. Imaging devices include printers, copiers, facsimile machines, and the like. That is, imaging devices include any type of device which is configured to produce a visual image on a sheet of media.

Prior art imaging devices often employ feed mechanisms which are configured to feed, or move, sheets of media through the imaging device. For example, a feed mechanism is often employed to pick sheets of media, one-at-a-time, from a stack of media in order to feed individual sheets of media into an imaging device. The feed mechanism, or other feed mechanisms, can be employed to feed the individual sheets of media through the imaging device as images are applied to the sheets of media, or as other such processes are performed on the sheets of media.

Feed mechanisms generally comprise rollers or the like for moving the sheets of media through the imaging device. The feed mechanisms also generally comprise various drive components which are configured to drive the rollers so as to impart rotation thereto. Feed mechanisms, then, include any components which are configured to facilitate the movement of sheets of media through the imaging device.

Feed mechanisms typically comprise gripping surfaces which are configured to contact and grip the sheets of media in order to facilitate the movement of the sheets of media through the imaging device. The gripping surfaces are often defined on the outer cylindrical surfaces of the rollers which make up the feed mechanisms. An example of a gripping surface is a relatively soft rubber coating on the roller. The rubber coating is preferably sufficiently soft so as to facilitate a relatively high static frictional force between the roller and the sheets of media. However, the rubber coating is also preferably not so soft as to leave a visible deposit or marking on the sheets of media as they are moved into and through the imaging device by the roller, or rollers.

As the prior art imaging devices are operated, the gripping surfaces tend to experience wear. This wear can be due to abrasion and the like from repeated contact with sheets of media as the media is moved by the gripping surfaces. The wear experienced by the gripping surfaces can cause problems with the operation of the feed mechanisms. In particular, the wear of the gripping surfaces can cause slippage of the gripping surfaces relative to the sheets of media. Such slippage and the like can, in turn, result in media jams and mis-feeds, as well as multiple media picks and the like.

What is needed then, are methods and apparatus for feeding media which achieve the benefits to be derived from similar prior art devices, but which avoid the shortcomings and detriments individually associated therewith.

SUMMARY OF THE INVENTION

The invention includes methods and apparatus for feeding, or moving, media along a media path. The apparatus can be employed, for example, in conjunction with an imaging device to move media along a media path which passes through the imaging device. A gripping surface is employed to contact, and thereby move, the media along the media path. The invention further includes methods and apparatus for increasing the force with which a gripping surface contacts the media in order to compensate for wear experienced by the gripping surface.

In accordance with one embodiment of the present invention, an apparatus includes a gripping surface and a wear compensator configured to selectively increase the force with which the gripping surface contacts the media.

In accordance with another embodiment of the present invention, a method includes providing a rotatable feed roller in an imaging device, the roller having a gripping surface defined thereon. The gripping surface is configured to contact and grip the media as the roller feeds sheets of media into and through the imaging device. The method also includes measuring the rotation of the feed roller and increasing the force with which the gripping surface contacts the media in response to measuring rotation of the feed roller.

In accordance with yet another embodiment of the present invention, a method includes providing a gripping surface defined on a feed roller or the like which can be used in an imaging device or the like. The imaging device is configured to generate an image on a sheet of media. In the method, the media is contacted by the gripping surface. A variable is measured and the force with which the gripping surface contacts the media is increased as a function of the measured variable. The measured variable can be, for example, a number of rotations of a feed roller, or a number of sheets of media which pass a given point.

DETAILED DESCRIPTION OF THE INVENTION

The invention includes methods and apparatus for feeding, or moving, media along a media path. The apparatus can be employed, for example, to move media along a media path which passes through an imaging device. A gripping surface is provided, which can be defined on a feed roller, for example. The gripping surface is employed to contact the media so as to move the media along the media path. In accordance with the instant invention, the force with which the gripping surface contacts the media is increased as a function of a measured variable. The measured variable is preferably the number of revolutions of the feed roller on which the gripping surface is defined.

The present invention is particularly suited for use in imaging devices such as computer printers, photocopiers, facsimile machines, and other devices in which sheets of media are fed, or moved, past an imaging section so that the imaging device can generate an image on the sheets of media. Such sheets of media can include sheets of paper, envelopes, card stock, clear plastic transparencies, or other media upon which an image can be generated by an imaging device.

Figure 1:
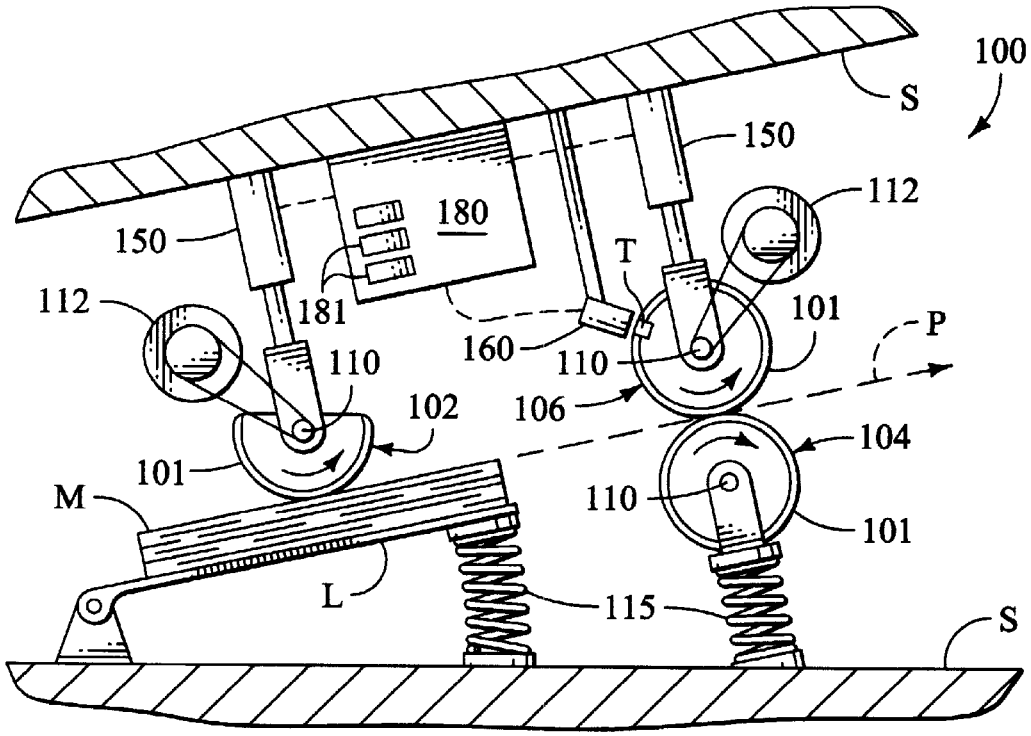
FIG. 1 is a schematic diagram depicting a side elevation view of an apparatus in accordance with one embodiment of the present invention.

Turning now to FIG. 1, a side elevation view is shown which depicts an apparatus 100 in accordance with a first embodiment of the present invention. The apparatus 100 comprises at least one feed roller 102, 104, 106 which is supported on a support "S" such as a chassis or frame or the like. Each of the feed rollers, such as the feed rollers 102, 106, can be configured to be driven, or made to rotate, about a respective axis of rotation 110 by a respective drive mechanism or the like 112 as shown. Alternatively, any of the feed rollers, such as the feed roller 104, can be configured to be non-driven, or free-spinning, such as roller 104. As is evident, the feed rollers 102, 104, 106 are configured to rotate in respective directions as indicated.

However, it is understood that the feed rollers 102, 104, 106 can be, in accordance with the instant invention, configured in alternate manners with respect to the configurations of the rollers described herein and shown in the accompanying figures. For example, the roller 104 can be configured in the manner of a retard roller, or back roller, which is driven in a direction opposite from that indicated in FIG. 1 by way of an overload clutch (not shown) or the like. Such a retard roller configuration is intended to prevent two sheets of media "M" from passing between the pair of rollers 104, 106 at the same time.

In the case wherein two sheets of media "M" are sandwiched between the pair of rollers 104, 106 at the same time, the retard roller (for example, 104) grips one of the sheets while the retard roller is driven in a direction opposite of the direction indicated so as to move the sheet in a direction opposite the direction of the media path "P." This occurs while the other sheet is moved by the roller 106 in the direction of the media path "P." That is, the frictional force between the two sheets of media is generally lower than the frictional force between each of the sheets and the respective contacting roller 104, 106. On the other hand, in the case wherein only a single sheet of media "M" is sandwiched between the pair of rollers 104, 106, the overload clutch (not shown) can be overcome by the force of the driven roller 106, which results in the retard roller (for example 104) turning in the direction indicated. Such retard roller configurations are known in the art.

The drive mechanism 112 can comprise, for example, an electric motor or the like which is mechanically linked to the respective feed roller 102, 106. The drive mechanism 112 can alternatively comprise only a linkage which connects the respective feed roller 102, 106 to a mechanical power source (not shown) which is configured to drive several feed rollers 102, 106, as well as other components of the apparatus 100. It is understood that the means for driving the feed rollers 102, 104 (and 106, if driven), is well known in the art and that such means need not be discussed further herein.

The feed rollers 102, 104, 106 can have any of a number of possible shapes. For example, as is shown, one of the feed rollers 102 can be in the form of a cylinder having a substantially "D"-shaped cross-section. This type of feed roller 102 can be particularly useful when employed as a "pick roller" which is configured to intermittently pick single sheets of media from the top of a stack of sheets of media "M." As a further example, at least one of the feed rollers 104, 106 can be in the form of a cylinder having a substantially circular cross-section.

Further examination of FIG. 1 will reveal that a gripping surface 101 is defined on each of the feed rollers 102, 104, 106. It is understood that the respective gripping surfaces 101 can be integral with the respective roller 102, 104, 106, or can alternatively be a separate coating or layer as depicted. The gripping surfaces 101 of each of the rollers 102, 104, 106 are configured to contact and grip sheets of media "M" as the media is fed along the media path "P" as shown. The gripping surfaces 101 are preferably fabricated from a relatively soft material, such as rubber or the like, and preferably have a tread pattern or the like defined therein so as to facilitate the gripping of media "M" for the movement thereof. It is understood that such gripping surfaces are well known in the art and that the configuration of the gripping surfaces need not be discussed in further detail herein.

Resilient members 115 such as springs or the like can be employed to assist in biasing the respective gripping surfaces 101 against the sheets of media "M" as the media is moved along the media path "P" by the feed rollers 102, 104, 106. For example, a pair of opposing feed rollers 104, 106 can be biased against one another by the action of a respective resilient member 115 as shown. Thus, as the sheets of media "M" pass between the opposing feed rollers 104, 106, the respective gripping surfaces 101 can be forced against the media by the action of the biasing member 115. Although the resilient members 115 are depicted as coil springs in the accompanying figures, it is understood that when I say "resilient member" I mean any device which is configured to store mechanical energy. Thus, resilient members 115 can include any type of mechanical spring, pneumatic spring, or the like.

It is also understood that when I say "feed roller" I mean to include any object on which a gripping surface 101 is defined, wherein the gripping surface is configured to grip a sheet of media "M" so as to move the media along a media path. Thus, a feed roller can comprise, for example, a flat, non-rotatable member (not shown) which has a gripping surface defined thereon. Furthermore, it is understood that any apparatus in accordance with the present invention can be employed alone or in conjunction with other devices, including imaging devices.

As is shown, another resilient member 115 can be employed to bias a lift plate "L" toward a respective feed roller 102. The lift plate "L" is configured to support thereon one or more media sheets "M." As the respective resilient member 115 biases the lift plate "L" toward the respective feed roller 102, the top of the stack of media "M" is biased against the gripping surface 101 of the respective feed roller. As is evident, the respective gripping surfaces 101 are biased against the sheets of media "M" in order to develop the required frictional forces there between for gripping and moving the sheets of media along the media path "P." Alternatively, the resilient members 115 can be omitted from the apparatus 100 as will be discussed below in greater detail.

The apparatus 100 comprises at least one wear compensator 150. Each wear compensator 150 can be connected between a respective feed roller 102, 106 and the support "S" as shown. However, it is understood that, although not depicted in the accompanying figures, the wear compensators 150 can be connected between, for example, the support "S" and components other than the feed rollers 102, 104, 106. For example, the wear compensator 105 can alternatively be connected between the support "S" and the lift plate "L."

As will become apparent in later discussion, the intended function of the wear compensators 150 is to compensate for the wear on the gripping surfaces 101. Such wear on the gripping surfaces 101 occurs over the operational life thereof as a result of abrasion and the like as discussed above. The wear compensators 150 perform the intended function thereof by increasing the force of the respective feed roller 102, 106 against the media sheets "M" as the respective gripping surface 101 experiences wear. Thus, the wear compensator 150 can be positioned with respect to, and connected between, any components of the apparatus 100 so as to cause an increase in force of the respective gripping surface 101 against the media "M." The configuration and function of the wear compensators 150 will be discussed in greater detail below.

The apparatus 100 can also comprise a counting device 160 which can be supported on the support "S" and which is preferably configured to measure the rotation of at least one feed roller, such as the feed roller 106 as shown. For example, the counting device 160 can be in the form of a sensor or the like which detects a trigger mark "T" which is mounted on the respective feed roller 106. That is, as the trigger mark "T" passes the counting device 160 during rotation of the respective feed roller 106, the counting device can detect such passing of the target during each revolution of the feed roller.

In this manner, the counting device 160 can count the number of revolutions made by the respective feed roller 106 during rotation thereof. The counting device 160 is preferably configured to transmit a signal which contains information regarding the number of revolutions of the respective feed roller 106. It is understood that the counting device 160 can be configured to measure the rotation of any of the feed rollers 102, 104, 106.

The trigger mark "T" can be anything that is configured to trigger, or be detected by, the counting device 160. For example, the trigger mark "T" can comprise a magnet, wherein the counting device 160 can comprise a coil or the like which is configured to detect the passing magnet as the respective feed roller 106 rotates. As another example, the trigger mark "T" can comprise a light-reflective surface such as a mirror or the like, wherein the counting device 160 can comprise a light source, such as an LED, and a light detector, such as a photo-electric cell.

In such a configuration, the counting device 160 can detect the passing light-reflective surface as the respective feed roller 106 rotates. The purpose of the counting device 160 will be discussed in greater detail below. It is understood that such detection means which are configured to measure rotation are known in the art and that many various configurations are possible.

As is further seen in FIG. 1, the apparatus 100 preferably comprises a controller 180 which is in signal communication with both the counting device 160 and the wear compensators 150 as shown. The controller 180 can comprise a processor (not shown) or the like, as well as a memory (not shown). The purpose of the controller is to control and coordinate the operational aspects of the apparatus 100. For example, the controller 180 can be configured to receive signals from the counting device 160. That is, the counting device 160 is preferably configured to send a signal to the controller 180 each time the counting device detects the passage of the trigger mark "T."

In this manner, the controller 180 can track the number of revolutions made by the respective feed roller 106. The controller 180 can also contain a sequence of computer-executable steps 181 for controlling the wear compensators 150 in response to the number of revolutions of the respective feed roller 106 as counted by the counting device 160. The function and operation of the controller 180 as well as the computer-executable steps 181 will be discussed in greater detail below.

Figure 2:
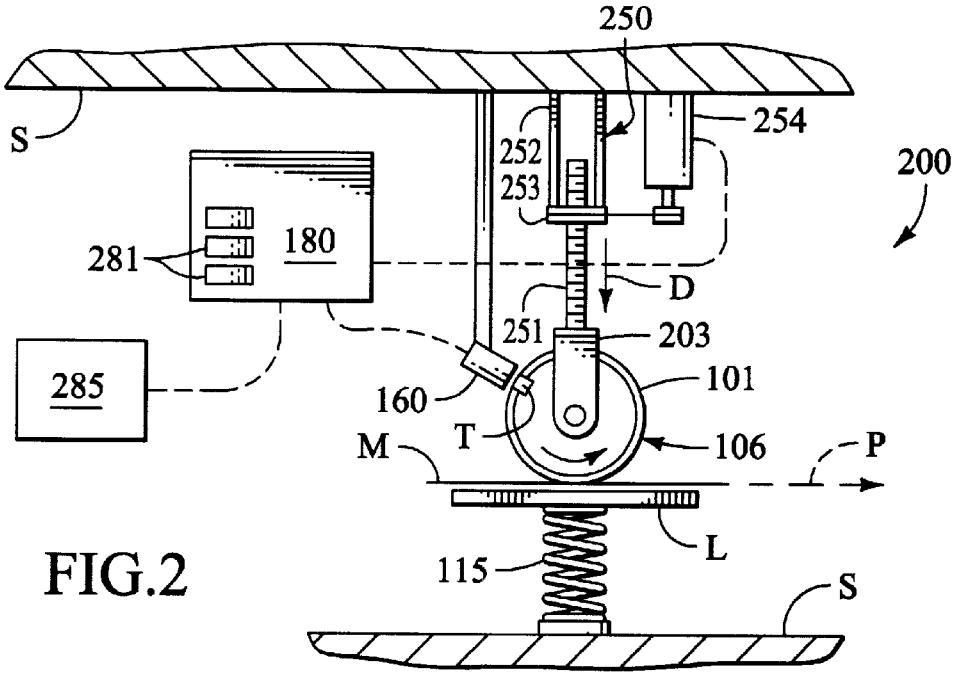
FIG. 2 is a schematic diagram depicting a side elevation view of an apparatus in accordance with another embodiment of the present invention.

Moving now to FIG. 2, a schematic diagram is shown of an apparatus 200 which is configured similarly to the apparatus 100 which is depicted in FIG. 1. For example, the apparatus 200 comprises the controller 180, the lift plate "L," the counting device 160, the resilient member 115, the feed roller 106, and the gripping surface 101 of the apparatus 100 (FIG. 1). The aforementioned components (180, "L," 160, 115, 106, 101) are configured to function in the respective manners as described above in conjunction with the description of the apparatus 100 (FIG. 1). The diagram of FIG. 2 is primarily intended to depict one of many possible alternative configurations of the wear compensator 150 of the apparatus 100 (FIG. 1). As will be discussed below, other configurations wear compensators are possible.

As is seen in FIG. 2, the wear compensator 250 comprises a camming surface 251, such as a threaded rod or the like as shown. The wear compensator 250 also comprises a cam follower 253 such as a threaded collar or the like as shown. The camming surface 251 is preferably fixedly connected to a yoke 203 which, in turn, supports the roller 106. That is, as shown, the camming surface 251 does not move with respect to the yoke 203. The camming surface 251 is engaged with the cam follower 253 as shown. That is, the wear compensator 250 can be configured as a jack screw or the like in the case wherein the camming surface 251 is a threaded rod, and wherein the cam follower 253 is a threaded collar which is threaded onto the threaded rod.

It is understood that the camming surface 251 and the cam follower 253 can be configured in any manner which allows the wear compensator 250 to function as intended. That is, the camming surface 251 and the cam follower 253 can be configured in any manner in accordance with which movement of the camming surface and the cam follower against each other results in an increase in force with which the gripping surface 101 contacts the media "M."

As is seen, the follower 253 is preferably supported by a base 252. A motive power source 254 is connected to the cam follower 253. The power source 254 is configured to selectively rotate the cam follower 253 so as to move the camming surface 251 in the direction "D." That is, the cam follower 253 can be rotated with respect to the camming surface 251 so as to cause the camming surface to move in the direction "D" which is substantially parallel to an axis (not shown) which is defined by the camming surface.

It is understood that the respective roles of the camming surface 251 and the cam follower 253 can be reversed in an alternative configuration which is not depicted in the accompanying figures. That is, alternatively, the camming surface 251 can be rotatably mounted to the yoke so as to be driven by the motive power source 254, while the cam follower 253 is alternatively fixedly mounted on the base 252 and engaged with the camming surface. In such an alternative configuration, the rotation of the camming surface 251 causes an increase in the force with which the gripping surface 101 contacts the media "M."

The motive power source 254 can be, for example, a small stepper motor or the like which is in signal communication with the controller 180 as shown. The controller 180 is also preferably in signal communication with the counting device 160 as shown. During operation of the apparatus 200, the counting device 160 counts the number of revolutions of the feed roller 106. The counting device 160 can send signals to the controller to notify the controller of the number of revolutions made by the feed roller 106.

The apparatus 200 preferably comprises a series of computer-executable steps 281 which can be executed by the controller 180. The computer-executable steps 281 are preferably configured to control the operation of the power source 254 as a function of the number of revolutions of the feed roller 106, as counted by the counting device 160. That is, the power source 254 is preferably selectively operated by the controller 180 so as to cause the camming surface 251 to incrementally move in the direction "D" as a function of the number of rotations made by the feed roller 106.

Since, typically, relatively minor adjustments will be made to the position of the camming surface 251 as a function of the number of rotations of the feed roller 106, the force-increasing algorithm comprising steps 281 can be configured to actuate the stepper motor 254 only after a predetermined number of rotations of the feed roller have occurred. For example, the steps 281 can be configured to incrementally actuate the stepper motor 254 after each group of 500 revolutions of the feed roller 106 (which can correspond, for example, to approximately 100 sheets of media "M," depending on the diameter of the roller relative to the length of a sheet of media).

The movement of the camming surface 251 in the direction "D" causes the feed roller 106 to also move in the direction "D" which, in turn, causes the resilient member 115 to compress. The compression of the resilient member 115 results in an increase in force of the feed roller 106 against the media "M" due to the compression of the resilient member 115. The increase in the force with which the feed roller 106 presses against the media "M" acts to compensate for wear experienced by the gripping surface 101 over time.

That is, as the gripping surface 101 wears, the apparatus 200 compensates for such wear by increasing the force with which the feed roller 106, and thus the gripping surface 101, presses against the media "M." The increase in this force is a function of the rotation of the feed roller 106. As is seen, the increase in force with which the gripping surface 101 presses against the media "M" is accomplished in conjunction with a resilient member 115, wherein the respective feed roller 106 is moved in the direction "D" so as to compress the resilient member.

As an alternative to basing the increase in force with which the gripping surface 101 presses against the media "M" on the number of revolutions of the respective feed roller 106, the increase in force can be based on a different variable. That is, the controller 180 can be configured to receive a signal from a signal generator 285, in which case the counting device 160 and trigger mark "T" can be omitted from the apparatus 200. The signal generator 285 is preferably configured to measure a variable and to send a signal to the controller 180, wherein the signal contains data regarding the measured variable.

The signal generator 285 can be any of a number of devices including a timer, wherein the variable measured by the signal generator is elapsed time. Thus, in such a case, the computer-executable steps 281 of the controller 180 can be configured to cause the wear compensator 250 to operate as otherwise discussed above, except that the operation of the wear compensator is based on elapsed time rather than a number of revolutions of the respective feed roller 106.

The elapsed time can be, for example, the operating time of an imaging device (not shown) in which the apparatus 200 is installed. The signal generator 285 can also be, for example, a portion of an imaging device (not shown), wherein the signal generator measures the number of images produced by the imaging device. In such a case, the operation of the wear compensator 150 is based on the number of images generated by the imaging device.

As yet a further alternative to the configuration of the apparatus 200 as depicted in FIG. 2, the counting device 160 can be configured to count sheets of media "M," or to measure lengths of media. In such a case, the operation of the wear compensator 250, and thus, the increase of the force of the gripping surface 101 against the media, is based on the number of sheets of media "M" which pass the counting device 160, or on the quantity of measured length of media which passes the counting device, respectively.

In other words, it is understood that the operation of the wear compensator 250 can be based on any variable that can be measured, wherein the variable is indicative of the likely wear of the gripping surface 101. Preferably, however, the variable is the number of revolutions of the respective feed roller 106 as measured by the counting device 160. This is because the number of revolutions of the feed roller 106 can provide the most accurate indication of the wear experienced by the gripping surface 101.

Figure 3:
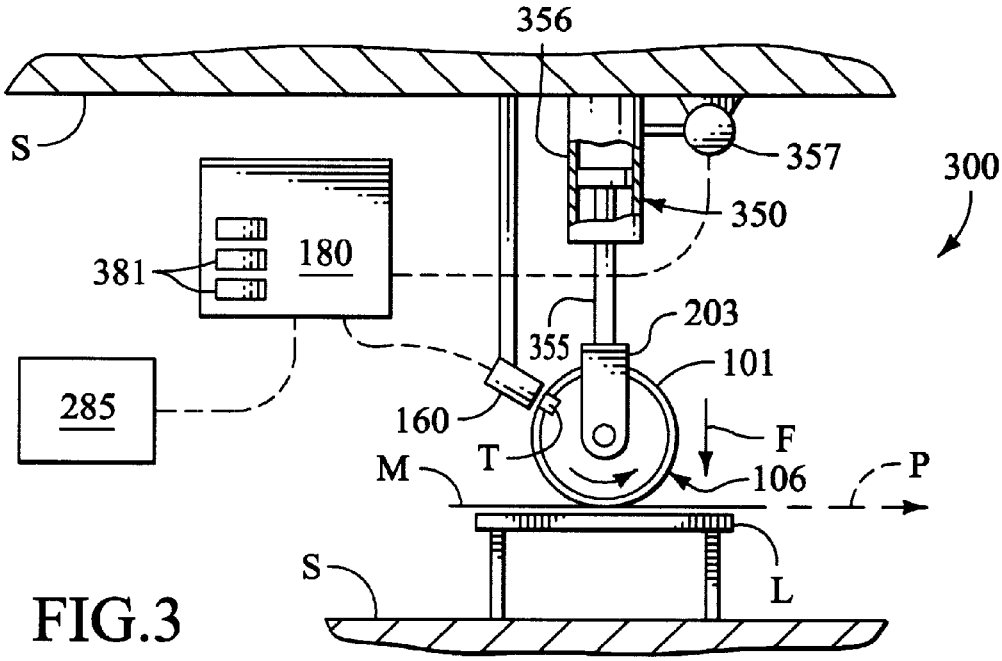
FIG. 3 is a schematic diagram depicting a side elevation view of an apparatus in accordance with yet another embodiment of the present invention.

Moving now to FIG. 3, a schematic diagram is shown which depicts an apparatus 300 in accordance with yet another embodiment of the present invention. The apparatus 300 is configured in a manner which is similar to that of the apparatus 200 (FIG. 2) except as noted below. That is, the apparatus 300 comprises the controller 180, the counting device 160, the yoke 203, the feed roller 106, and the gripping surface 101 which are all configured to function in respective manners as described above for FIG. 2. The apparatus 300 can also include the signal generator 285 which is also configured to function in the manner of which is described above for the signal generator in conjunction with the description of the apparatus 200 of FIG. 2.

As is evident from a study of FIG. 3, the apparatus 300 also comprises a lift plate "L" which is configured so that the lift plate "L" is substantially rigidly mounted to a support "S" rather than supported by a resilient member 115 as depicted in FIGS. 1 and 2. As further revealed in FIG. 3, the apparatus 300 comprises a wear compensator 350 which is in the form of an actuator. When I say "actuator" I mean a device which is configured to be connected between two objects, and which is configured to apply a selectively variable force between the two objects. The primary purpose of FIG. 3 is to depict yet another alternative configuration of the wear compensator 150 of the apparatus 100 which is depicted in FIG. 1.

As a study of FIG. 3 reveals, the wear compensator 350 of the apparatus 300 can be a fluid-powered actuator which is configured as a pneumatic cylinder, a hydraulic cylinder, or the like. When I say "fluid-powered actuator" I mean an actuator which is configured to actuate by way of pressurized fluid which can include pressurized liquid or pressurized gas. That is, the compensator 350 can comprise a piston/piston rod assembly 355 which is slidably disposed within a cylinder 356.

The apparatus 300 preferably comprises a pressure source 357 such as a fluid pump, pressure tank, pressure accumulator, or the like. The apparatus 300 can also include a pressure regulator (not shown) or the like which is connected between the pressure source 357 and the wear compensator 350. The pressure source 357 is configured to selectively apply a variable pressure (for example, by way of the pressure regulator) to the interior of the cylinder 356 so as to produce a selectively variable force "F" substantially in the direction shown.

During operation of the apparatus 300, the counting device 160 preferably counts the revolutions made by the feed roller 106. The counting device 160 sends signals to the controller 180 so as to notify the controller of the number of revolutions made by the feed roller 106. As is seen, a series of computer-executable steps 381 can be included in the apparatus 300. The computer-executable steps 381 are preferably configured to cause the pressure source 357 to incrementally deliver increases in pressure to the cylinder 356 as a function of the number of revolutions made by the respective feed roller 106.

The increases in pressure delivered by the pressure source 357 to the cylinder 356 cause an increase in force "F" of the gripping surface 101 against the media "M" as the media is moved along the media path "P." It is noted that the respective feed roller 106 need not be moved toward the media "M" in order to achieve and increase in force of the gripping surface 101 against the media. The increase in force "F" of the gripping surface 101 against the media "M" serves to compensate for wear experienced by the gripping surface. As is evident by the inclusion of the signal generating device 285, as shown, it is understood that the operation of the wear compensator 350 can be alternatively based on any measured variable, as discussed above with regard to the apparatus 200 (FIG. 2), wherein the variable is indicative of wear experienced by the gripping surface.

Figure 4:
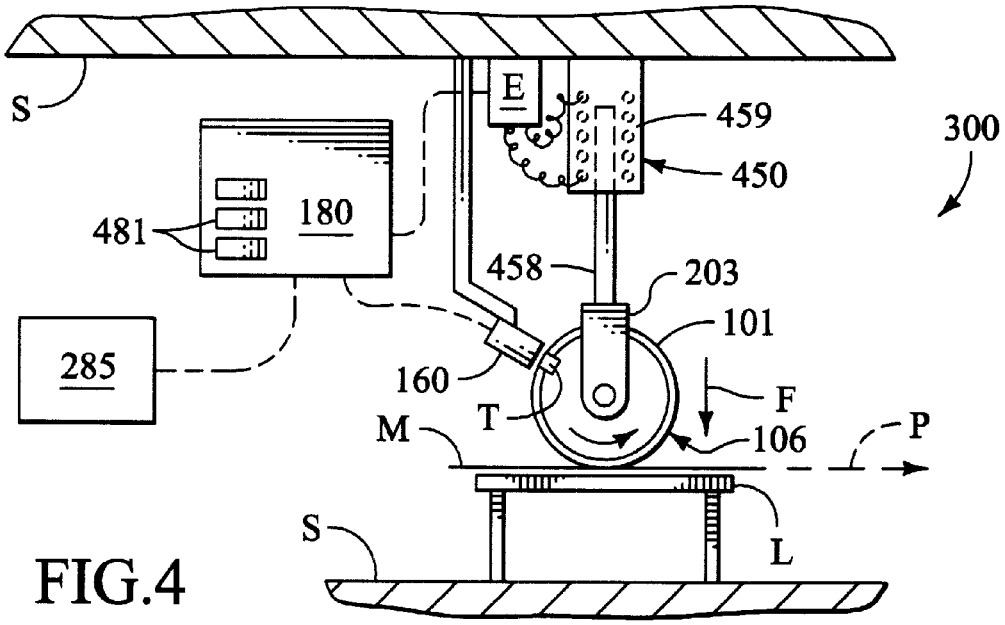
FIG. 4 is a schematic diagram depicting a side elevation view of the apparatus shown in FIG. 3 with an alternative configuration of the wear compensator.

Moving now to FIG. 4, a schematic diagram is shown which depicts the apparatus 300 with an alternative embodiment of a wear compensator 450. As is evident, the apparatus 300 which is shown in FIG. 4 is configured in a manner substantially identical to the configuration which is depicted in FIG. 3 with the exception of the wear compensator 450. Specifically, as shown in FIG. 4, the wear compensator 450 can be configured in the manner of an electrical solenoid rather than the manner of an actuator as depicted in FIG. 3. As shown in FIG. 4, the wear compensator 450 can comprise a plunger 458 which is slidably disposed within a coil assembly 459. The plunger 458 is preferably fabricated from a material comprising Iron so as to be affected by a magnetic field.

The coil assembly 459 is preferably electrically connected to an electrical power supply "E." The electrical power supply "E" is preferably configured to provide selectively variable amounts of electrical power to the coil assembly 459 so as to exert a selectively variable amount of force "F" on the plunger 458 by way of an electro-magnetic field produced by electrical energy circulating in the coil assembly 459.

For example, the electrical power supply "E" can be configured to selectively supply a variable amount of electrical current to the coil assembly as controlled by the controller 180. The current supplied to the coil assembly can induce a selectively variable electromagnetic field which exerts a selectively variable force "F" on the plunger 458. The force "F" produced as a result of the electromagnetic field can serve to cause the respective feed roller 106, by way of the yoke 203, to press the gripping surface 101 against the media "M" as the media is moved along the media path "P."

As is apparent from a study of FIG. 4, while the apparatus 300 is in operation, the counting device 160 can count the number of revolutions made by the respective feed roller 106 as the media "M" is moved along the media path "P." The counting device 160 can send signals to the controller 180 to notify the controller of the number of revolutions made by the respective feed roller 106. As is indicated by the inclusion of the signal generator 285, the controller 180 can alternatively receive signals containing variables such as elapsed time and the like.

As is seen, the apparatus 300 can include a series of computer-executable steps 481. The computer-executable steps 181 can control the operation of the electrical power supply "E" so as to vary the amount of electrical power supplied to the wear compensator 450 as a function of the number of revolutions of the feed roller 102 as counted by the counting device 160. As mentioned above, the amount of electrical power supplied to the wear compensator 450 can alternatively be a function of another variable such as elapsed time or a number of sheets of media "M" which pass along the media path "P."

In this manner, the controller 180 can cause an increase in the force "F" of the gripping surface 101 against the media "M" as a function of the number of revolutions made by the feed roller 106, or other variable which is indicative of the wear experienced by the gripping surface 101. That is, as the respective feed roller 106 rotates, the gripping surface 101 experiences wear due to abrasion and the like. The counting device 160, in conjunction with the controller 180, counts the number of revolutions made by the feed roller 106.

In response to the increasing number of revolutions made by the feed roller 106, the controller 180 causes, by way of the wear compensator 450, an increase in force of the gripping surface 101 against the media "M." The increase in force "F" can serve to compensate for the wear experienced by the gripping surface 101. As discussed above, it is understood that the operation of the wear compensator 450 can be alternatively based on any measured variable related to actual or anticipated wear of the gripping surface 101 such as elapsed time, or a number of sheets of media "M" which pass along the media path "P."

Figure 5:
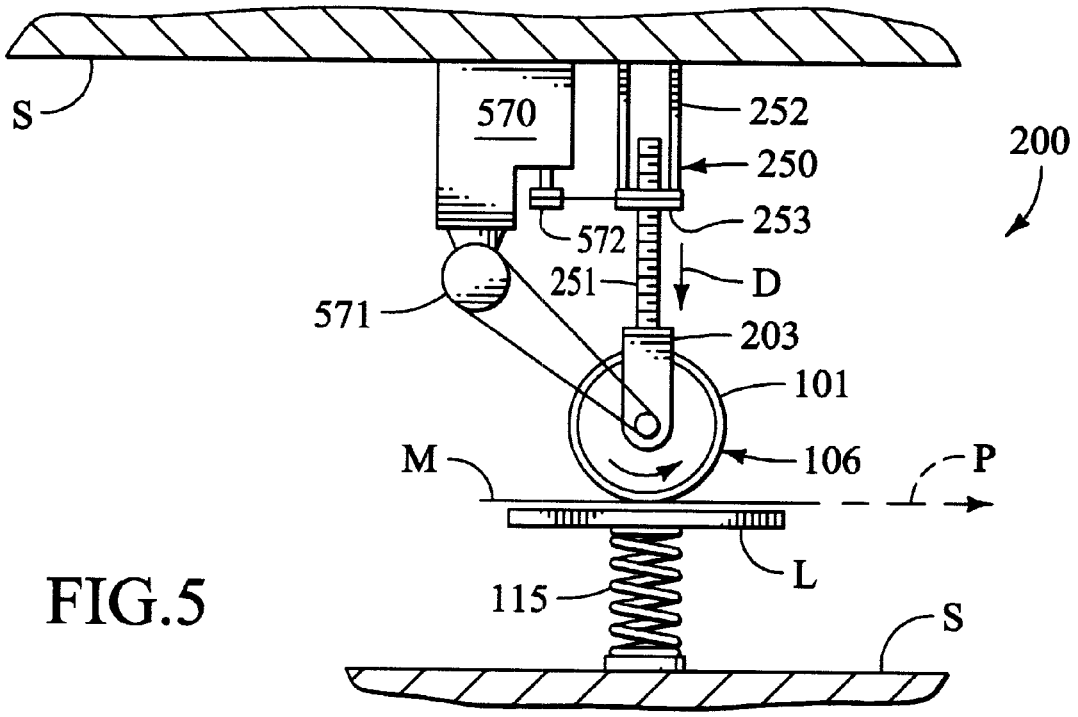
FIG. 5 is a schematic diagram depicting a side elevation view of the apparatus shown in FIG. 2 with an alternative configuration of the wear compensator.

Moving now to FIG. 5, a schematic diagram is shown which depicts an alternative configuration of the apparatus 200 which is depicted in FIG. 2. As is evident, the apparatus 200 as depicted in FIG. 5 can be configured in a manner which is substantially identical to that of the apparatus 200 as depicted in FIG. 2. Specifically, the apparatus 200 which is depicted in FIG. 5 is identical to the apparatus 200 which is depicted in FIG. 2, except that the controller 180, the counting device 160, and the motive power source 254 depicted in FIG. 2 have been omitted in FIG. 5, and a gear box 570 has been added to the apparatus.

As is seen, the gear box 570 has an input connection 571 and an output connection 572. The input connection 571 is mechanically linked to the feed roller 106, while the output connection 572 is mechanically linked to the cam follower 253 of the wear compensator 250. In operation, the feed roller 106 is rotated in the direction indicated by way of a drive mechanism 112 (FIG. 1) or the like. The rotation of the feed roller 106 causes the input connection 571 to rotate. The rotation of the input connection 571 is reduced by the gear box 570, wherein the output connection 572 is caused to rotate at a significantly slower rate than the input connection.

The rotation of the output connection 572 causes a rotation of the cam follower 253 which, in turn, causes movement of the camming surface 251 in the direction "D."

As the camming surface 251 is caused to move in the direction "D," the feed roller 106 is also moved in the direction "D" so as to cause the resilient member 115 to become compressed. Such a compression of the resilient member 115 causes an increase in the force with which the gripping surface 101 presses against the media "M" as the media is moved along the media path "P." As discussed above, such an increase in force with which the gripping surface 101 presses against the media "M" can serve to compensate for wear experienced by the gripping surface.

Alternatively, the gear box 570 can be configured as a drive mechanism having a first output connection 571 and a second output connection 572. That is, in the alternative, the gear box 570 can be configured to drive both the respective feed roller 106 as well as the cam follower 253 by way of the first output connection 571 and the second output connection 572, respectively. In such a case, the first output connection 571 is preferably configured to turn considerably faster than the second output connection 572 because the cam follower 253 preferably turns substantially more slowly than the feed roller 106.

Referring now to FIG. 2 as well as FIG. 5, it is understood that the lift plate "L" of the apparatus 200 can be replaced by a second feed roller as is illustrated by the pair of opposing feed rollers 104, 106 which are depicted in FIG. 1. It is further understood from a study of FIGS. 2 and 5 that the resilient member 115 of the apparatus 200 can be alternatively located between the wear compensator 250 and the feed roller 106, wherein such a case the lift plate "L" is preferably rigidly supported on the respective support "S."In this case, the movement of the camming surface 251 in the direction "D" causes the resilient member 115 to compress between the camming surface and the feed roller 106, thus causing an increase in the force with which the roller is pressed against the media "M."

Referring now to FIGS. 3 and 4, it is understood that the lift plate "L" of the apparatus 300 can be replaced by a second feed roller as is illustrated by the pair of opposing feed rollers 104, 106 which are depicted in FIG. 1. It is equally understood that the respective wear compensator 350, 450 of the apparatus 300 can be employed in conjunction with a resilient member as in the manner of the resilient member 115 which is employed in conjunction with the wear compensator of the apparatus 200 as is described above for FIGS. 2 and 5.

It is further understood that, rather than counting the number of revolutions of the respective feed roller 102, 104, 106, the apparatus 100, 200, 300 of the present invention can be configured to count the number of sheets of media "M" which are fed through the respective apparatus. In this manner, the force with which the gripping surface 101 contacts the media "M" can be increased as a function of the number of sheets of media that are fed through the apparatus 100, 200, 300. That is, the respective computer-executable steps 181, 281, 381, 481 can be configured to count the number of sheets of media "M" which are fed through the apparatus 100, 200, 300 and to increase the force with which the gripping surface 101 contacts the media as a function of the number of sheets of media so counted.

In accordance with still another embodiment of the present invention, a method of feeding media along a media path comprises providing a rotatable feed roller having a gripping surface defined thereon, wherein the gripping surface is configured to contact the media. The media path can be defined, for example, in an imaging device. One example of such a feed roller is the roller 106 shown in FIG. 1 and described above.

The method also includes measuring the rotation of the feed roller, and further includes increasing the force with which the gripping surface contacts the media in response to measuring rotation of the feed roller. When I say "measuring the rotation of the feed roller" I mean to include counting the number of revolutions of the feed roller. When I say "in response to" I mean to include "as a function of." That is, the force with which the gripping surface contacts the media can be increased as a function of the number of revolutions made by the feed roller. One example of a device which can be used to measure the number of revolutions of the feed roller is the counting device 160 of FIG. 1, which is described above.

The force with which the gripping surface contacts the media can be increased continuously in direct proportion to the number of revolutions made by the feed roller. Alternatively, the force with which the gripping surface contacts the media can be increased incrementally in direct proportion to the number of revolutions made by the feed roller. When I say "increased incrementally," I mean increased discontinuously, wherein the increase is accomplished in predetermined incremental steps at predetermined intervals, and wherein an interval can correspond to a predetermined number of revolutions of the feed roller.

The force with which the gripping surface contacts the media can be increased linearly in direct proportion to the number of revolutions made by the feed roller. Alternatively, the force with which the gripping surface contacts the media can be increased non-linearly, such as exponentially, logarithmically, or parabolically or the like. A series of computer-executable steps such as the steps 181, 281, 381, 481 can be employed in conjunction with a wear compensator, such as the compensators 150, 250, 350, 450, to cause an increase in the force with which the gripping surface contacts the media.

In accordance with a further embodiment of the present invention, a method of moving media along a media path comprises providing a gripping surface and contacting the media with the gripping surface such as the gripping surface 101 which is described above. The gripping surface can be defined, for example, on a feed roller or the like such as the feed roller 106 which is described above. The gripping surface can be a portion of an imaging device, or the like.

The method also includes measuring a variable which has some relationship to the actual, estimated, or probable wear experienced by the gripping surface as a result of the contact between the gripping surface and the media. The variable can be, for example, elapsed time or the number of revolutions of a feed roller. The variable can also be the number of sheets of media which pass a given point on the media path. As yet another example, the variable can be the number of images which are produced by an imaging device or the like, and which contact the gripping surface. An example of a device which measures a variable is the counting device 160 which is described above The method also includes increasing the force with which the gripping surface contacts the media as a function of the variable. That is, the force with which the gripping surface contacts the media can be increased in direct proportion to an increase in the measured variable. For example, if the variable is elapsed time, the force with which the gripping surface contacts the media can be increased in direct proportion to the amount of time which elapses from a given start time. Or, if the variable is the number of sheets of media which pass a given point on the media path, the force can be increased in direct proportion to the number of sheets of media which are counted.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of moving media along a media path, comprising:

providing a gripping surface, wherein the gripping surface has an operational life;

contacting the media with the gripping surface;

measuring a variable a plurality of times throughout the operational life of the gripping surface; and, increasing the force with which the gripping surface contacts the media in response to each subsequent measurement of the variable.

2. The method of claim 1, and wherein the variable is selected from the group consisting of:

elapsed time;

rotation of a feed roller;

movement of sheets of media past a given point; and a number of images produced.

3. A method of moving media along a media path, comprising:

providing a rotatable feed roller having a gripping surface defined thereon, wherein the gripping surface is configured to contact the media;

measuring the rotation of the feed roller; and, increasing the force with which the gripping surface contacts the media in response to measuring rotation of the feed roller.

4. The method of claim 3, and wherein measuring the rotation of the feed roller comprises counting the revolutions thereof.

5. The method of claim 4, and wherein increasing the force with which the gripping surface contacts the media comprises increasing, in a substantially continuous manner, the force with which the gripping surface contacts the media as a function of the number of counted revolutions of the feed roller.

6. The method of claim 5, and wherein the force with which the gripping surface contacts the media is increased substantially linearly.

7. The method of claim 4, and wherein increasing the force with which the gripping surface contacts the media comprises intermittently increasing the force with which the gripping surface contacts the media as a function of the number of counted revolutions of the feed roller.

8. The method of claim 4, and wherein increasing the force with which the gripping surface contacts the media in response to measuring rotation of the feed roller comprises incrementally increasing the force with which the gripping surface contacts the media as a function of the number of counted revolutions of the feed roller.

9. An apparatus for moving sheets of media along a media path defined in an imaging device, comprising:

a gripping surface that has an operational life;

a wear compensator configured only to selectively increase the force with which the gripping surface contacts the media, wherein the force is not decreased by the wear compensator during the operational life of the gripping surface.

10. The apparatus of claim 9, and further comprising:

a rotatable feed roller; and, a counting device configured to count the revolutions made by the feed roller, wherein the wear compensator is configured to increase the force with which the gripping surface contacts the media as a function of the number of revolutions made by the feed roller.

11. The apparatus of claim 10, and further comprising:

a controller in signal communication with the wear compensator and with the counting device;

a sequence of computer-executable steps which are executable by the controller and which are configured to cause the wear compensator to increase the force with which the gripping surface contacts the media as a function of the number of revolutions made by the feed roller.

12. The apparatus of claim 9, and further comprising a resilient member, wherein the wear compensator is configured to compress the resilient member, and wherein the compression of the resilient member is configured to cause an increase in force with which the gripping surface contacts the media.

13. A method of moving media along a media paths comprising:

providing a gripping surface, wherein the gripping surface has an operational life;

contacting the media with the gripping surface;

making a plurality of measurements of a variable throughout the operational life of the gripping surface; and, increasing the force with which the gripping surface contacts the media in response to each measurement of the variable, wherein the force is not decreased during the operational life of the gripping surface.

* * * * *

UNITED STATES PATENT AND TRADEMARK OFFICE

CERTIFICATE OF CORRECTION

PATENT NO. : 6,578,842 B2
DATED : June 17, 2003
INVENTOR(S) : Tim M. Hoberock

It is certified that error appears in the above-identified patent and that said Letters Patent is hereby corrected as shown below:

Column 6,
Line 27, after "configuration" insert -- of --

Column 13,
Line 22, after "variable" insert -- of --

Column 14,
Line 42, delete "paths" and insert therefor -- path --
Line 42, after "path" insert -- , --

Signed and Sealed this

Eighteenth Day of January, 2005

JON W. DUDAS
*Director of the United States Patent and Trademark Office*